United States Patent [19]

Beermann

[11] Patent Number: 4,837,931

[45] Date of Patent: Jun. 13, 1989

[54] DEVICE FOR CUTTING PIECES FROM A SUBSTANTIALLY CYLINDRICAL ARTICLE

[75] Inventor: Ewald H. Beermann, Solingen, Fed. Rep. of Germany

[73] Assignee: Martor-Argentax E.H. Beermann KG, Solingen, Fed. Rep. of Germany

[21] Appl. No.: 67,593

[22] Filed: Jun. 26, 1987

[30] Foreign Application Priority Data

Jun. 26, 1986 [DE] Fed. Rep. of Germany ..... 3621399

[51] Int. Cl.[4] ..... B26B 27/00

[52] U.S. Cl. ..... 30/92; 30/112; 30/278

[58] Field of Search ..... 30/111–113, 30/93, 278, 333, 337, 92

[56] References Cited

U.S. PATENT DOCUMENTS

| | | | |
|---|---|---|---|
| 1,186,291 | 6/1916 | Davis . | |
| 1,816,422 | 7/1931 | Coleman | 30/112 X |
| 2,828,543 | 4/1958 | Valentine | 30/333 X |

FOREIGN PATENT DOCUMENTS

| | | | |
|---|---|---|---|
| 79923 | 8/1919 | Austria . | |
| 322675 | 5/1919 | Fed. Rep. of Germany . | |
| 406482 | 11/1924 | Fed. Rep. of Germany . | |
| 622328 | 11/1935 | Fed. Rep. of Germany | 30/111 |

*Primary Examiner*—Douglas D. Watts

*Attorney, Agent, or Firm*—Herbert Dubno

[57] ABSTRACT

The apparatus for cutting off a substantially cylindrical piece from a cylindrical object comprises a handle with a gap like cavity in which a knife blade carried by a blade holder is pivotable. The blade holder is substantially U-shape. In the side arms of the U-shape blade holder recesses are provided which form supporting surfaces for the end regions of the knife blade. Advantageously a U-shape cover is provided with projecting pins which holds the knife blade in place in the blade holder. A transverse pivot passage in the blade holder outside of the blade contour with a radial slot extending therefrom can provide a catch opening for a pivot bolt anchored in the handle.

10 Claims, 3 Drawing Sheets

FIG.1
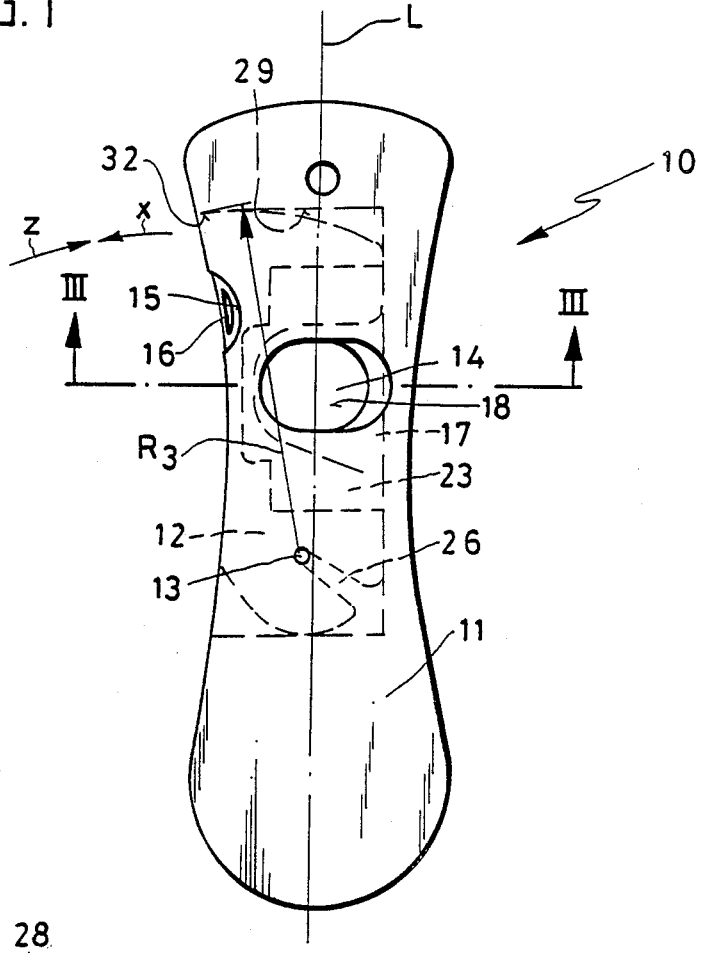
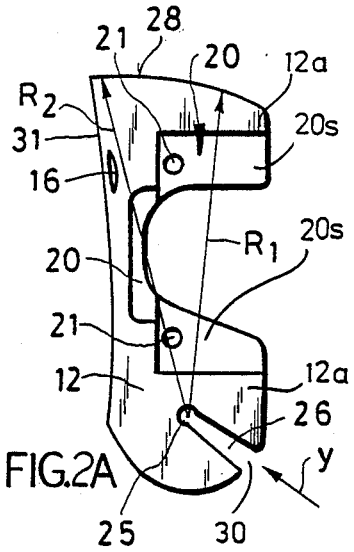
FIG.2A
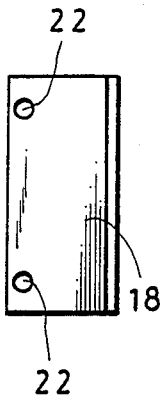
FIG.2B
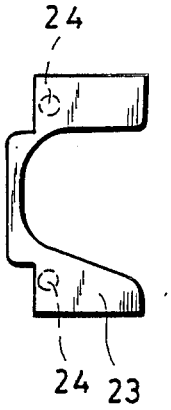
FIG.2C

FIG. 3
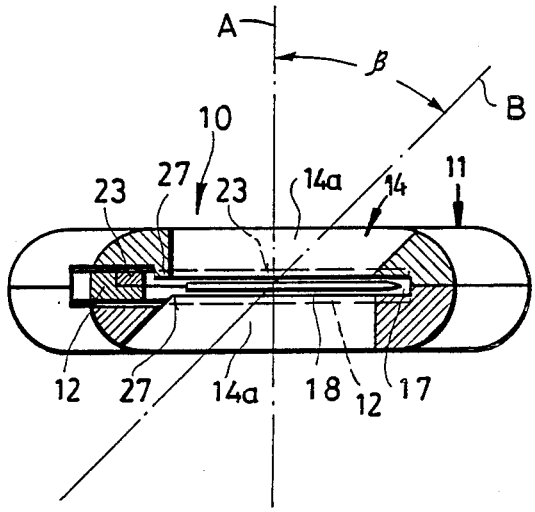
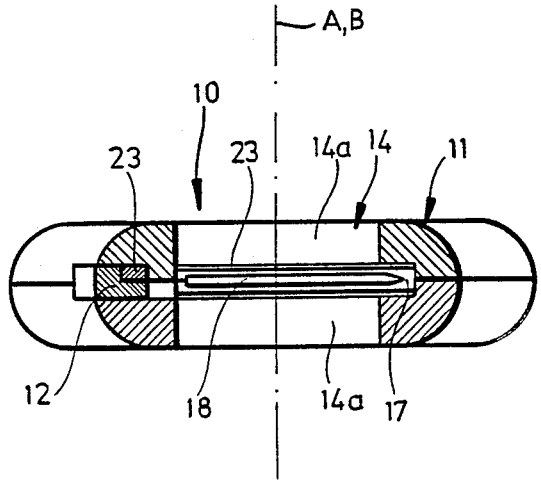
FIG.5

DEVICE FOR CUTTING PIECES FROM A SUBSTANTIALLY CYLINDRICAL ARTICLE

FIELD OF THE INVENTION

My present invention relates to an device for cutting off a piece from an object, particularly a piece from a generally cylindrical article.

BACKGROUND OF THE INVENTION

A device for cutting pieces from cylindrical articles can have a handle having a gap-like cavity in which a knife blade, carried in a blade holder, is pivotable.

This cutting device can be represented by the well known cigar cutter. The blade in this cutter is usually a razor blade.

For cutting off the ends of a cigar the known device may operate correctly because the material being cut is loose and soft.

For harder items, however, such as plastic pipe or rods, the cutter is unsuitable because of the lack of stability of the razor blade weakened by its central holes.

However, sawing through harder items leads to rough end surfaces and thus to sealing difficulties, while pinching off usually results in a disadvantageous deformation of the shape.

OBJECTS OF THE INVENTION

It is an object of my invention to provide an improved device for cutting off a piece from a generally cylindrical article which will avoid the aforedescribed drawbacks.

It is also an object of my invention to provide an improved device for cutting off a piece from a generally cylindrical article, particularly a plastic object, so that the resulting pipelike or rodlike piece is cut off smoothly without rough edges.

It is another object of my invention to provide an improved device for cutting off a piece, especially of a comparatively hard material such as a plastic, so that the pipe like or rod like piece produced has smooth edges but the cutting blade of the cutting device is more stable than heretofore, requiring less frequent replacement.

SUMMARY OF THE INVENTION

These objects and others which will become more readily apparent hereinafter are attained in accordance with my invention in an device for cutting off a piece from a generally cylindrical article comprising a handle having a gap-like cavity in which a knife blade carried in a blade holder is pivotable.

Thus a stronger free knife blade, swingable from a central opening of the cutter, which is firmly steadily guided by the supporting surfaces on the lateral arms of the blade holder is available. The free space between the arms of the blade holder makes a sufficiently large portion of the knife edge available for the cutting process.

According to a feature of my invention the supporting surfaces for the knife blade are formed in the blade holder by recesses and are overlapped by a cover. Thus the knife blade is clamped between the blade holder and the cover so that reliable guiding is guaranteed. Since the center of gravity of the knife holder with the knife blade received therein and the cover in place in the blade-retracted state is at least at the end of the retraction path inside of the gap-like cavity in the handle a loosening of the cover and thus an unintended release of the blade is prevented.

Advantageously the blade holder has holder holes corresponding to blade holes provided in the end region of the knife blade which are penetratable by projecting pins of the cover. Thus the blade holder, knife blade and cover can be reliably fitted together so that good blade guidance and a stable overall structure result.

The blade holder advantageously has a transverse pivot passage outside of the knife blade contour which is penetrated by a pivot bolt anchored in the handle. Thus the knife blade experiences hardly any weakening by the passages required for receiving the pivot bolt. The knife blade has only the blade openings for the projecting pins of the cover in its end regions.

The transverse pivot passage of the knife blade for receipt of the pivot bolt, according to another feature of my invention, is connected by a radial slot with the periphery of the blade holder by which the knife holder is insertable on the pivot bolt. The replacement of the knife blade, when required, is then particularly easy.

The slot can be inclined to the longitudinal axis of the blade holder so that, during use of the device, inadvertently sliding out of the holder is not to be feared. Advantageously the pivot passage then has a catch opening for the pivot bolt at the end of the slot.

In a particularly advantageous construction, in accordance with my invention, the handle has a transverse opening for the pieces to be cut in the pivoting region of the knife blade. The rod shaped or pipe like pieces can be fed into the transverse opening for the cutting process and a force can be exerted on the rear end of the blade holder to effect cutting. A safe holding is guaranteed and danger of injury to the operator is practically nonexistent.

In the standard case the axis of the transverse opening is substantially perpendicular to the surface of the handle. The transverse opening can however be formed by two overlapping generally cylindrical passages of the handle whose axes intersect in the plane of the knife blade and are at an angle of about 45° to each other. Thus it is possible to make either a cut surface perpendicular to the longitudinal axis of the object or also a slanted cut surface with the same device as may be desirable in the case of a container spout for application of an adhesive or sealing means.

It is also appropriate to provide an interiorly directed bulge on the circumference of the transverse opening of the handle. This bulge contacts the knife blade in the cutting process and offers a substantially improved blade guidance and thus a higher quality cut.

BRIEF DESCRIPTION OF THE DRAWING

The above and other objects, features and advantages of my invention will become more readily apparent from the following description, reference being made to the accompanying highly diagrammatic drawing in which:

FIG. 1 is a top view of a cutting device according to my invention;

FIGS. 2A to 2C are elevational views of the blade holder, the knife blade and a cover for the blade according to my invention;

FIG. 3 is an enlarged cross sectional taken along the section line III—III of FIG. 1;

FIG. 5 is an enlarged cross sectional view of another embodiment of the cutting device according to my invention similar to that of FIG. 3.

SPECIFIC DESCRIPTION

Figure 4:
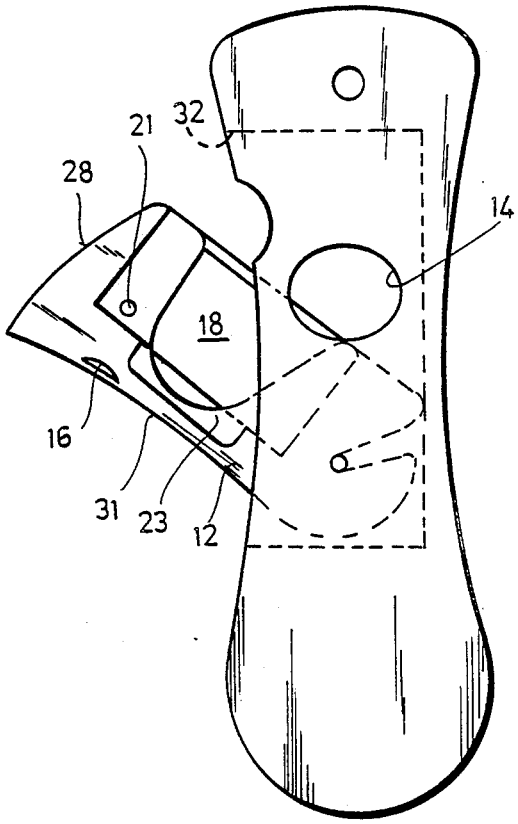
FIG. 4 is a view similar to FIG. 1 showing the blade holder swing out, ready for cutting.

FIG. 1 shows the cutting device which is represented with the reference number 10 as a whole in the retracted, closed or folded together state (cf. FIG. 4 where the blade holder is in its open state). The handle 11, formed as a flat block, is constricted in its center to provide a better grip. The ends and corners are rounded.

The blade holder 12 which is inside the handle 11 in FIG. 1 is indicated only with dashed lines in FIG. 1. The transverse pivot bolt 13 passes through both halves of the handle 11 and is nearly flush with the outer surface of the handle 11. The transverse bolt 13 is anchored in the handle 11.

In the center or middle of the handle 11 there is a transverse opening 14 whose shape and form are illustrated in more detail with reference to FIG. 3 below. A sickle-shaped depression 15 is provided on a lateral edge of the handle 11 in which a portion of the rear of the blade holder 12 can be seen. A groove 16 provided in the blade holder 12 in the vicinity of this depression 15 provides for engagement with a finger or finger nail for pivoting the blade holder 12 out from the handle 11.

The gap-like cavity 17 located inside the handle 11 for receiving the blade holder 12 is indicated in FIG. 1 only by dashed lines.

The knife blade 18, the blade holder 12 and cover 23 are shown separately in FIGS. 2A–2C.

The blade holder 18 (FIG. 2A) is substantially U-shape, each arm 12*a* of this U-shape holder 18 being provided with a recess 20 which has a supporting surface 20*s* for an end region of the knife blade 18 (FIG. 2B). Holder holes 21 are provided near these supporting surfaces 20*s* of recesses 20 which can be brought into coincidence with corresponding blade holes 22 in the ends of the knife blades 18.

The cover 23 (FIG. 2C) is likewise of substantially U-shape. A suitable space is provided in the blade holder 12 between the legs of the U for this U-shaped bridge piece. The cover 23 carries two molded projecting pins 24 which project into the plane of the drawing in FIG. 2 and engage in the mounted state in the blade holes 22 in the knife blade 18 and the holder holes 21 of the blade holder 12 to hold the knife blade 18 fixed in the blade holder 12.

The blade holder 12 is substantially semicircular on its end closest the pivot point and is provided centrally with a pivot passage 25.

A radial slot 26 extends from the passage 25, is inclined to the longitudinal axis of the blade holder 12, and has a width which is somewhat smaller than the diameter of the passage 25. Thus the pivot passage 25 has a catch opening for the pivot bolt 13 already described in connection with FIG. 1.

With the blade holder 12 folded out (FIG. 4) the pivot bolt 13 can be pulled out of this catch opening against the catch resistance so that replacement of the knife blade 18 is possible. The cover 23 is removed and the pins 24 are released from the holes 21 and 22 of the blade holder 12 and/or the knife blade 18.

As is shown particularly in FIG. 3 the transverse opening 14 passing through the handle 11 comprises two generally cylindrical passages 14*a* whose axes A and B intersect in the plane of the knife blade 18. Both axes A and B are oriented at an ångle $\beta$ which is approximately 45°. The items to be cut away can be brought into the transverse opening 14 from different directions so that a suitably inclined cut surface results from the cutting process. When the article is inserted into hole 14, the blade holder is swung inwardly to cut off a piece from the article.

Both halves of the handle 11 carry an interiorly directed bulge 27 on the periphery of the transverse opening 14 which contacts on the free portion of the knife blade 18 and guides it during the cutting process.

In addition the blade holder 12 and/or the portion of the blade holder 12 in the clamped region together with the knife blade 18 and the cover 19 fill the gap-like space 17.

Correspondingly the inner surface of the gap-like space 17 forms a guide inside of the handle 11 for the blade holder 12 and simultaneously holds the cover 23 fixed on the blade holder 12 so that the knife blade 18 is reliably held in place as long as the pivot passage 25 is in engagement with the pivot bolt 13.

The disassembly of the entire blade holder 12 for replacement of the knife blade 18 is effected as follows: The blade holder 12 is swung out in the direction x (to the position shown in FIG. 4) and is pulled in the direction y of the slot 26 from the engaged position.

After removal of the used and insertion of the new knife blade 18 the reassembly of the unit including the blade holder 12 proceeds in the following very simple way: the inner region of the blade holder 12 is inserted in the gap-like hollow space 17 so that the outer slot mouth 30 surrounds the pivot bolt 13. Then a force is exerted continuously on the top small side in the pivot direction z. Thus the convex edge 28 of the free front side of the blade holder 12 slides to a rolling point 32 on the outer portion of an interior edge 29 of the handle 11 extending interiorly toward the handle longitudinal axis L. The radius described by the convex edge 28 on pivotal motion in the direction z varies from $R_1$ to $R_2$ so that the passage 25 is forced into its catch position on the pivot bolt 13 by simple inward impact on the holder. The radius $R_3$ (the distance of the rolling point 32 to the pivot bolt 13) is slightly greater than the largest of the radii $R_2$ by a small amount of motion play.

Advantageously the slot 26 is slightly wedge shaped converging from its mouth 30 to the pivot passage 25 which makes mounting and demounting of the blade holder 12 easy.

FIG. 5 shows an alternative embodiment of the cutting device for cutting pieces in which the passages 14*a* comprising the transverse opening 14 have longitudnal axes A,B substantially perpendicular to the surface of the handle 11.

I claim:

1. In a device for cutting a piece from a generally cylindrical article, the device comprising a handle having a gap-like cavity in which a knife blade carried in a blade holder is pivotable, the improvement wherein said blade holder is substantially U-shaped and has arms provided with a plurality of supporting surfaces for said knife blade, said supporting surfaces are formed by a plurality of recesses in said blade holder and are overlapped by a cover, said blade holder is provided with a transverse pivot passage beyond the contour of said knife blade and traversed by a pivot bolt anchored in said handle, and said transverse pivot passage of said blade holder is formed at an enlarged inner end of a slot extending straight from the pivot passage to the periphery of said blade holder, said blade holder being engageable in a snap fit at the passage on said pivot bolt by sliding of same along said slot.

2. The improvement according to claim 1 wherein the slot is inclined with respect to a longitudinal axis of said blade holder.

3. In a device for cutting a piece from a generally cylindrical article, the device comprising a handle having a gap-like cavity in which a knife blade carried in a blade holder is pivotable, the improvement wherein said blade holder is substantially U-shaped and has arms provided with a plurality of supporting surfaces for said knife blade, said supporting surfaces are formed by a plurality of recesses in said blade holder and are overlapped by a cover, said handle has a transverse opening for receipt of said pieces to be cut in a pivoting range of said knife blade, and said transverse opening is formed by two overlapping generally cylindrical passages through said handle whose axes intersect approximately in the plane of said knife blade at an angle of about 45° to each other.

4. In a device for cutting a piece from a generally cylindrical article, the device comprising a handle having a gap-like cavity in which a knife blade carried in a blade holder is pivotable, the improvement wherein said blade holder is substantially U-shaped and has arms provided with a plurality of supporting surfaces for said knife blade, said supporting surfaces are formed by a plurality of recesses in said blade holder and are overlapped by a cover, said handle has a transverse opening for receipt of said pieces to be cut in a pivoting range of said knife blade, and said transverse opening of said handle has an inwardly directed bulge extended from each half of said handle on the outer circumference of said transverse opening.

5. The improvement defined in claim 1 wherein said blade holder has an arcuate end surface with a radius of curvature centered on said transverse pivot passage and increasing from a front side of said blade holder at which a cutting edge of said knife blade is disposed toward a rear side of said blade holder opposite said front side.

6. The improvement defined in claim 5 wherein said cavity is formed with a rolling edge at a distance from a center of said transverse pivot passage which is slightly greater than the largest radius of curvature of said arcuate surface, said arcuate surface engaging said rolling edge as said blade holder is inserted into said cavity to drive said pin from said radial slot into said transverse pivot passage.

7. The improvement defined in claim 6 wherein said radial slot converges toward said transverse pivot passage.

8. A device for cutting pieces off a cylindrical article, the device comprising:

a knife blade;

a substantially U-shape blade holder for said knife blade and having arms provided with a plurality of supporting surfaces for said knife blade and also with a plurality of holder holes corresponding to blade holes provided in the end regions of said knife blade;

a handle formed by a pair of similar halves forming a gap-like cavity in which said knife blade in said blade holder is pivotable, said blade holder being provided with a transverse pivot passage beyond the contour of said knife blade which is traversed by a pivot bolt anchored in said handle and connectable by a radial slot with the periphery of said blade holder, said radial slot being inclined with respect to the longitudinal axis of said blade holder;

a cover for said knife blade overlapping said supporting surfaces of said blade holder and provided with a plurality of projecting pins which are engageable in said holder holes of said blade holder and through said blade holes of said knife blade, the handle being formed with a transverse opening for receipt of said pieces to be cut in the pivoting range of said knife blade and comprising two overlapping generally cylindrical passages through said handle whose axes intersect approximately in the plane of said knife blade at an angle of about 45° with respect to each other; and an inwardly directed bulge protruding from each half of said handle on the outer circumference of said transverse opening.

9. A knife for cutting a substantially cylindrical element, the knife comprising:

a generally flat elongated handle formed internally with a hollow;

a blade holder receivable in said hollow and swingably mounted on said handle so as to be fully enclosed by said handle in an operative position and to extend partly from said handle in an inoperative position, said blade holder having a substantially flat U-shape with a pair of arms flanking an opening in said blade holder, said arms each being formed with a supporting surface parallel to a plane of swinging movement of said holder; and a flat blade fixed on said holder, resting on said supporting surfaces formed on said arms, and having a cutting edge extending between said arms across and exposed in said opening in said operative position of said holder to enable said blade to sever a piece from said cylindrical element upon insertion of said cylindrical element between said edge and said handle in said operative position, said blade holder further having an arcuate end surface with a radius of curvature centered on said transverse pivot passage and increasing from a front side of said blade holder at which the cutting edge of said knife blade is disposed toward a rear side of said blade holder opposite said front side, the hollow being dimensioned to engage the arcuate surface at the rear holder side in the operative position of the holder.

10. The knife defined in claim 9 wherein each of said arms is formed with a recess having a bottom defining the respective supporting surface, said blade being received in said recesses and said blade holder being formed with a cover member conforming in shape to said recesses, received in said recesses and overlying said blade.

* * * * *